US010446171B2

(12) United States Patent
Kaskari et al.

(10) Patent No.: US 10,446,171 B2
(45) Date of Patent: Oct. 15, 2019

(54) ONLINE DEREVERBERATION ALGORITHM BASED ON WEIGHTED PREDICTION ERROR FOR NOISY TIME-VARYING ENVIRONMENTS

(71) Applicant: SYNAPTICS INCORPORATED, San Jose, CA (US)

(72) Inventors: Saeed Mosayyebpour Kaskari, Irvine, CA (US); Francesco Nesta, Aliso Viejo, CA (US); Trausti Thormundsson, Irvine, CA (US)

(73) Assignee: SYNAPTICS INCORPORATED, San Jose, CA (US)

( * ) Notice: Subject to any disclaimer, the term of this patent is extended or adjusted under 35 U.S.C. 154(b) by 0 days.

(21) Appl. No.: 15/853,693

(22) Filed: Dec. 22, 2017

(65) Prior Publication Data

US 2018/0182410 A1 Jun. 28, 2018

Related U.S. Application Data

(60) Provisional application No. 62/438,860, filed on Dec. 23, 2016.

(51) Int. Cl.
*G10L 21/0232* (2013.01)
*G10L 25/18* (2013.01)
(Continued)

(52) U.S. Cl.
CPC ..... *G10L 21/0232* (2013.01); *G10L 25/18* (2013.01); *G10L 2021/02082* (2013.01); *G10L 2021/02166* (2013.01)

(58) Field of Classification Search
CPC ..... G10L 21/0232; G10L 25/18; G10L 2021/02082; G10L 2021/02166
See application file for complete search history.

(56) References Cited

U.S. PATENT DOCUMENTS

2003/0206640 A1 11/2003 Malvar et al.
2006/0002546 A1 1/2006 Stokes, III et al.
(Continued)

FOREIGN PATENT DOCUMENTS

JP 2010245697 A * 10/2010
KR 10-1401120 5/2014

OTHER PUBLICATIONS

Schartz et al, Online Speech Dereverberation using kalman Filter and EM Algorithm, IEEE, 2015.*
(Continued)

*Primary Examiner* — Davetta W Goins
*Assistant Examiner* — Kuassi A Ganmavo
(74) *Attorney, Agent, or Firm* — Haynes and Boone, LLP

(57) ABSTRACT

Systems and methods for processing multichannel audio signals include receiving a multichannel time-domain audio input, transforming the input signal to plurality of multi-channel frequency domain, k-spaced under-sampled sub-band signals, buffering and delaying each channel, saving a subset of spectral frames for prediction filter estimation at each of the spectral frames, estimating a variance of the frequency domain signal at each of the spectral frames, adaptively estimating the prediction filter in an online manner using a recursive least squares (RLS) algorithm, linearly filtering each channel using the estimated prediction filter, nonlinearly filtering the linearly filtered output signal to reduce residual reverberation and the estimated variances, producing a nonlinearly filtered output signal, and synthesizing the nonlinearly filtered output signal to reconstruct a dereverberated time-domain multi-channel audio signal.

20 Claims, 5 Drawing Sheets

(51) Int. Cl.
*G10L 21/0208* (2013.01)
*G10L 21/0216* (2013.01)

(56) References Cited

U.S. PATENT DOCUMENTS

| | | | | |
|---|---|---|---|---|
| 2009/0214054 | A1 | 8/2009 | Fujii et al. | |
| 2009/0271005 | A1* | 10/2009 | Christensen | G10L 21/00 700/19 |
| 2010/0254555 | A1 | 10/2010 | Elmedyb et al. | |
| 2011/0002473 | A1 | 1/2011 | Nakatani et al. | |
| 2011/0129096 | A1 | 6/2011 | Raftery | |
| 2012/0275613 | A1 | 11/2012 | Soulodre | |
| 2015/0016622 | A1* | 1/2015 | Togami | H04R 3/02 381/66 |
| 2015/0063581 | A1 | 3/2015 | Tani et al. | |
| 2015/0117649 | A1* | 4/2015 | Nesta | H04R 3/005 381/17 |

OTHER PUBLICATIONS

Jukic et al, Group Sparsity for MIMO Speech Dereverberation, IEEE, 2015.*

Srommen et al, The Undersampled wireless acoustic sensor network scenario some preliminary results and open research issues, IEEE, 2009.*

Gustaffson et al, Robust Online estimation, 1999.*

Ito et al., "Probabilistic Integration of Diffuse Noise Suppression and Dereverberation," 2014 IEEE International Conference on Acoustic, Speech and Signal Processing (ICASSP), May 2014, pp. 5167-5171, Florence, Italy.

Jukic et al., "Group Sparsity for MIMO Speech Dereverberation," 2015 IEEE Workshop on Applications of Signal Processing to Audio and Acoustics, Oct. 18-21, 2015, 5 Pages, New Peitz, New York.

Jukic et al., "Multi-channel Linear Prediction-Based Speech Dereverberation With Sparse Priors," IEEE/ACM Transactions on Audio, Speech, and Language Processing, Sep. 2015, pp. 1509-1520, vol. 23, No. 9.

Keshavarz et al., "Speech-Model Based Accurate Blind Reverberation Time Estimation Using an LPC Filter," IEEE Transactions on Audio, Speech, and Language Processing, Aug. 2012, pp. 1884-1893, vol. 20, No. 6.

Mosayyebpour et al., "Single-Microphone Early and Late Reverberation Suppression in Noisy Speech," IEEE Transactions on Audio, Speech, and Language Processing, Feb. 2013, pp. 322-335, vol. 21, No. 2.

Mosayyebpour et al., "Single-Microphone LP Residual Skewness-Based for Inverse Filtering of the Room Impulse Response," IEEE Transactions on Audio, Speech, and Language Processing, Jul. 2012, pp. 1617-1632, vol. 20, No. 5.

Nakatani et al., "Speech Dereverberation Based on Variance-Normalized Delayed Linear Prediction," IEEE Transactions on Audio, Speech, and Language Processing, Sep. 2010, pp. 1717-1731, vol. 17, No. 7.

Schwartz et al., "Online Speech Dereverberation Using Kalman Filter and EM Algorithm," IEEE/ACM Transaction on Audio, Speech, and Language Processing, Feb. 2015, pp. 394-406, vol. 23, No. 2.

Togami et al., "Optimized Speech Dereverberation From Probabilistic Perspective for Time Varying Acoustic Transfer Function," IEEE Transactions on Audio, Speech, and Language Processing, Jul. 2013, pp. 1369-1380, vol. 21, No. 7.

Yoshioka et al., "Adaptive Dereverberation of Speech Signals with Speaker-Position Change Detection," 2009 IEEE International Conference on Acoustics, Speech and Signal Processing, Apr. 19-24, 2009, pp. 3733-3736.

Yoshioka, Takuya, "Dereverberation for Reverberation-Robust Microphone Arrays," 21st European Signal Processing Conference (EUSIPCO 2013), Jan. 2013, pp. 1-5, Marrakech, Morocco.

Yoshioka et al., "Generalization of Multi-Channel Linear Prediction Methods for Blind MIMO Impulse Response Shortening," IEEE Transactions on Audio, Speech, and Language Processing, Dec. 2012, pp. 2707-2720, vol. 20, No. 10.

Yoshioka et al., "Integrated Speech Enhancement Method Using Noise Suppression and Dereverberation," IEEE Transactions on Audio, Speech and Language Processing, Feb. 2009, pp. 231-246, vol. 17, No. 2.

* cited by examiner

ONLINE DEREVERBERATION ALGORITHM BASED ON WEIGHTED PREDICTION ERROR FOR NOISY TIME-VARYING ENVIRONMENTS

CROSS-REFERENCE TO RELATED APPLICATIONS

This application claims the benefit of and priority to U.S. Provisional Patent Application No. 62/438,860 filed Dec. 23, 2016, and entitled "ONLINE DEREVERBERATION ALGORITHM BASED ON WEIGHTED PREDICTION ERROR FOR NOISY TIME-VARYING ENVIRONMENTS," which is incorporated herein by reference in its entirety.

TECHNICAL FIELD

The present application relates generally to audio processing, and more specifically to dereverberation of multichannel audio signals.

BACKGROUND

Reverberation reduction solutions are known in the field of audio signal processing. Many conventional approaches are not suitable for use in real-time applications. For example, a reverberation reduction solution may require a long buffer of data to compensate for the effect of reverberation or to estimate an inverse filter of the Room Impulse Responses (RIR). Approaches that are suitable for real-time applications do not perform reasonably well in high reverberation and especially high non-stationary environments. In addition, such solutions require a large amount of memory and it is not computationally efficient for many low power devices.

One conventional solution is based on weighted prediction error (WPE), which assumes an autoregressive model of the reverberation process, i.e., it is assumed that the reverberant component at a certain time can be predicted from previous samples of reverberant microphone signals. The desired signal can be estimated as the prediction error of the model. A fixed delay is introduced to avoid distortion of the short-time correlation of the speech signal. This algorithm is not suitable for real-time processing and does not explicitly model the input signal in noisy conditions. Also, the WPE method, has high complexity and is not Online multiple-input multiple-output (MIMO) solution. The WPE approach has been extended for MIMO and generalized for use in noisy condition. However, such modifications are not suitable for time-varying environments. Further modifications for time-varying environments have been proposed, which include both WPE for linear filtering and an optimum combination of the beamforming and a Wiener-filtering-based nonlinear filtering. However, such proposals are still not real-time and are not suitable for use in low power devices because of its high complexity.

Generally, conventional methods have limitations in complexity and practicality for use in on-line and real-time applications. Unlike batch processing, a real-time or online processing is used in industry for many practical applications. There is therefore a need for improved systems and methods for online and real-time dereverberation.

SUMMARY

Systems and methods including embodiments for online dereverberation based on weighted prediction error for noisy time-varying environments are disclosed. In various embodiments, method for processing multichannel audio signals includes receiving an input signal comprising a time-domain, multi-channel audio signal, transforming the input signal to a frequency domain input signal comprising a plurality of multi-channel frequency domain, k-spaced under-sampled subband signals, buffering and delaying each channel of the frequency domain input signal, saving a subset of spectral frames for prediction filter estimation at each of the spectral frames, and estimating a variance of the frequency domain input signal at each of the spectral frames, adaptively estimating the prediction filter in an online manner, by using a recursive least squares (RLS) algorithm. The method further includes linearly filtering each channel of the frequency domain input signal using the estimated prediction filter to produce a linearly filtered output signal, nonlinearly filtering the linearly filtered output signal to reduce residual reverberation and the estimated variances, producing a nonlinearly filtered output signal, and synthesizing the nonlinearly filtered output signal to reconstruct a dereverberated time-domain, multi-channel audio signal, wherein a number of output channels is equal to a number of input channels.

In various embodiments, the method may further include estimating the variance of the frequency domain input signal further comprises estimating a clean speech variance, estimating a noise variance, and/or estimating a residual speech variance. In various embodiments, the method may further include using an adaptive RLS algorithm to estimate the prediction filter at each frame independently for each frequency bin of the frequency domain input signal by imposing sparsity to a correlation matrix.

In various embodiments, the input signal comprises at least one target signal, and the nonlinear filtering computes an enhanced speech signal for each target signal to reduce residual reverberation and background noise. The variance estimation process may include estimating a new clean speech variance based on a previous estimated prediction filter, estimating a new residual reverberation variance using a fixed exponentially decaying weighting function with a tuning parameter to customize an audio solution, and estimating a noise variance using a single-microphone noise variance estimation method to estimate the noise variance for each channel and then compute an average. The method may also detect sudden changes to reset the prediction filter and correlation matrix in the event of speaker movement.

In various embodiments, an audio processing system includes an audio input, a subband decomposition module, a buffer, a variance estimator, a prediction filter estimator, a linear filter, a non-linear filter and a synthesizer. The audio input is operable to receive a time-domain, multi-channel audio signal. The subband decomposition module is operable to transform the input signal to a frequency domain input signal comprising a plurality of multi-channel frequency domain, k-spaced under-sampled subband signals. The buffer is operable to buffer and delay each channel of the frequency domain input signal, saving a subset of spectral frames for prediction filter estimation at each of the spectral frames.

In various embodiments, the variance estimator is operable to estimate a variance of the frequency domain input signal at each of the spectral frames. The variance estimator may be further operable to estimate a clean speech variance, a noise variance, and/or a residual speech variance. The variance estimator may be further operable to estimate a new clean speech variance based on a previous estimated prediction filter, estimate a new residual reverberation variance using a fixed exponentially decaying weighting function with a tuning parameter to customize an audio solution, and estimate a noise variance using a single-microphone noise variance estimation method to estimate the noise variance for each channel and then computing an average. The variance estimator may be further operable to detect changes due to speaker movement and to reset the prediction filter and the correlation matrix.

In one or more embodiments, the prediction filter estimator is operable to adaptively estimate the prediction filter on an online manner, by using a recursive least squares (RLS) algorithm. The prediction filter may be further operable to use an adaptive RLS algorithm to estimate the prediction filter at each frame independently for each frequency bin of the frequency domain input signal by imposing sparsity to a correlation matrix.

In various embodiments, the linear filter is operable to linearly filter each channel of the frequency domain input signal using the estimated prediction filter to produce a linearly filtered output signal. The non-linear filter is operable to nonlinearly filter the linearly filtered output signal to reduce residual reverberation and the estimated variances, producing a nonlinearly filtered output signal. In one embodiment, the time-domain, multi-channel audio signal comprises at least one target signal and the nonlinear filter is further operable to compute an enhanced speech signal for each target signal, and reduce residual reverberation and background noise. The synthesizer is operable to synthesize the nonlinearly filtered output signal to reconstruct a dereverberated time-domain, multi-channel audio signal, wherein a number of output channels is equal to a number of input channels.

The scope of the invention is defined by the claims, which are incorporated into this section by reference. A more complete understanding of embodiments of the invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Aspects of the disclosure and their advantages can be better understood with reference to the following drawings and the detailed description that follows. It should be appreciated that like reference numerals are used to identify like elements illustrated in one or more of the figures, wherein showings therein are for purposes of illustrating embodiments of the present disclosure and not for purposes of limiting the same. The components in the drawings are not necessarily to scale, emphasis instead being placed upon clearly illustrating the principles of the present disclosure.

DETAILED DESCRIPTION

Figure 1:
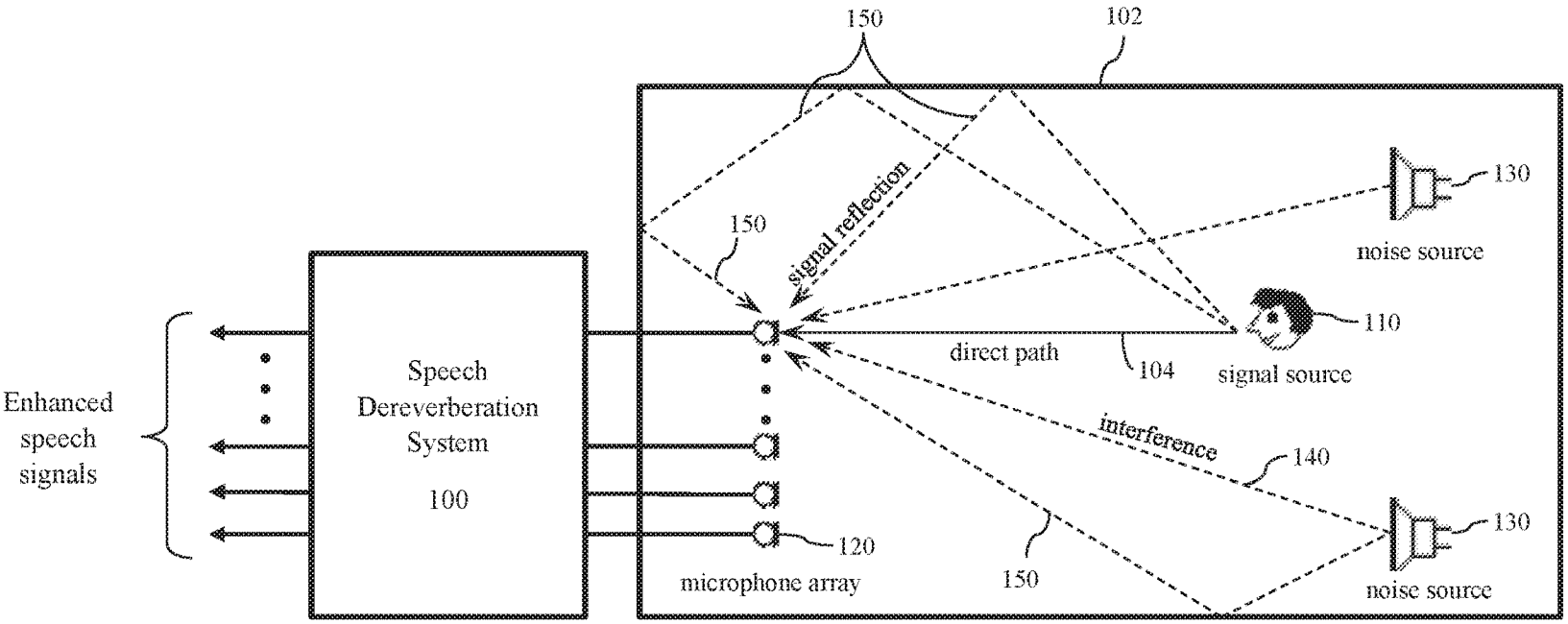
FIG. 1 is a block diagram of a speech dereverberation system in accordance with an embodiment of the present disclosure.

In accordance with various embodiments of the present disclosure, systems and methods for dereverberation of multi-channel audio signals are provided.

Generally, conventional methods have limitations in complexity and practicality for use in on-line and real-time applications. Unlike batch processing, a real-time or online processing has been used in industry for many practical applications. Online adaptive algorithms have been developed for these applications, such as a Recursive Least Squares (RLS) method to develop the adaptive WPE approach, or a Kalman filter approach where a multi-microphone algorithm that simultaneously estimates the clean speech signal and the time-varying acoustic system is used. The recursive expectation-maximization scheme is employed to obtain both the clean speech signal and the acoustic system in an online manner. However, both in the RLS-based and Kalman filter based algorithms, the methods do not perform well in highly non-stationary conditions. In addition, the computational complexity and memory usage for both Kalman and RLS algorithms are unreasonably high for many applications. Plus, despite their fast convergence to the stable solution, the algorithms may be too sensitive to sudden changes and may require a change detector to reset the correlation matrices and filters to their initial values.

Online multiple-input multiple-output (MIMO) embodiments for dereverberation using subband-domain are disclosed herein. In various embodiments, multi-channel linear prediction filters adapted to blindly shorten the Room Impulse Responses (RIRs) between a set of unknown number of sources and microphones are estimated on-line. In one embodiment, a RLS algorithm is used for fast convergence. However, some approaches using RLS may be characterized by high computational complexity. In various environments, low computational complexity and low memory consumption may be desired. In various embodiment of systems and methods disclosed herein, memory usage and the computational complexity is reduced by imposing sparsity to a correlation matrix. In one embodiment, a new method is proposed of identifying the movement of a speaker or audio source in time-varying environments, including reinitialization of the prediction filters and improving the convergence speed in time-varying environments.

In various real world environments, a speech source may be mixed with environmental noise. A recorded speech signal typically includes unwanted noise, which can degrade the speech intelligibility for voice applications, such as Voice over IP (VoIP) communications, and can decrease the performance of speech recognition performance of devices such as phones, laptops and voice controlled appliances. One approach to addressing the problem of noise interference is to use a microphone array and beamforming algorithms which can exploit the spatial diversity of noise sources to detect or extract desired source signals and to suppress unwanted interference. Beamforming represents a class of such multichannel signal processing algorithms and suggests a spatial filtering which points a beam of increased sensitivity to desired source locations while suppressing signals originating from other locations.

In indoor environments, the noise suppression approaches may be more effective as the signal source is closer to the microphones, which may be referred to as a near-field scenario. However, noise suppression may be more complicated when the distance between source and microphones is increased.

Referring to FIG. 1, a signal source 110, such as a human speaker, is located a distance away from an array of microphones 120 in an environment 102, such as a room. The microphone array 120 collects a desired signal 104 received in a direct path between the signal source 110 and the microphone array 120. The microphone array 120 also collects noise from noise sources 130, including noise interference 140 and signal reflections 150 off of walls, the ceiling and/or other objects in the environment 102.

The performance of many microphone array processing techniques, such as sound source localization, beamforming and Automatic Speech Recognition (ASR) may be sensibly degraded in reverberant environments, such as illustrated in FIG. 1. For example, reverberation can blur the temporal and spectral characteristics of the direct sound. Speech enhancement in a noisy reverberant environment may need to address speech signals that are colored and nonstationary, noise signals that can change dramatically over time, and an impulse response of an acoustic channel which may be long and/or have a non-minimum phase. In various applications, the length of the impulse response depends on the reverberation time and many methods may fail to work with high reverberation times. Disclosed herein are systems and methods for noise robust multi-channel speech dereverberation that reduce the effect of reverberation while producing a multichannel estimation of the dereverberated speech signal.

Conventional methods for addressing reverberation have limitations that make the methods unsuitable for many applications. For example, computational complexity may render an algorithm impractical for many real-world cases that require real-time, online processing. Such algorithms may also require high memory consumption that is not suitable for embedded devices that may require memory efficient algorithms. In a real environment, the reverberant speech signals are usually contaminated with nonstationary additive background noise, which can greatly deteriorate the performance of dereverberation algorithms that do not explicitly address the nonstationary noise in their model. Many dereverberation methods use batch approaches that require a large amount of input data to result in a good performance. However, in applications such as VoIP and hearing aids, I/O latency is undesirable.

Many conventional dereverberation methods produce a smaller number of dereverberated signals as microphones in an input microphone array, and do not conserve the time differences of arrival (TDOAs) at various microphone positions. In some applications, however, source localization algorithms may be explicitly or implicitly based on TDOAs at microphone positions. Other drawbacks of conventional dereverberation methods may include algorithms that require knowledge of the number of sound sources and methods that do not converge fast, thus making the algorithm slow to respond to new changes.

The embodiments disclosed herein address limitations of conventional systems providing solutions for use in different applications in industry. In one embodiment, an algorithm provides fast convergence and no latency which makes it desirable for applications like VOIP. A blind method uses multi-channel input signals for shortening a MIMO RIR between a set of unknown number of sources. Subband-domain multi-channel linear prediction filters are used and the algorithm estimates the filter for each frequency band independently. One advantage of this method is that it can conserve TDOAs at microphone positions as well as the linear relationship between sources and microphones which is beneficial if it is required to do further processing for localization and reduction of the noise and interference. In addition, the algorithm can yield as many dereverberated signals as microphones by estimating the prediction filter for each microphone separately. Additive background noise may also be considered in the model to adaptively estimate the prediction filter in an online-manner using an adaptive algorithm. In this manner, the algorithm may adaptively estimate the Power Spectral Density (PSD) of the noise.

Embodiments of the present disclosure provide numerous advantages over conventional approaches. Various embodiments provide real-time dereverberation with no latency. A MIMO algorithm is disclosed so it can be easily integrated with other multichannel signal processing blocks, e.g. for doing noise reduction or source location. Embodiments disclosed herein are memory and computational efficient requiring less MIPS. The solutions are robust to time-varying environments and are fast to converge. In various embodiments, nonlinear filtering may be skipped to further reduce the noise and the residual reverberation, allowing the algorithm to provide linear processing which may be critical for some applications which require the linearity. The solutions are robust to non-stationary noise and can perform well in high reverberant conditions. The solutions can be both single-channel and multi-channel, and can be extended for the case of more than one source.

Figure 2:
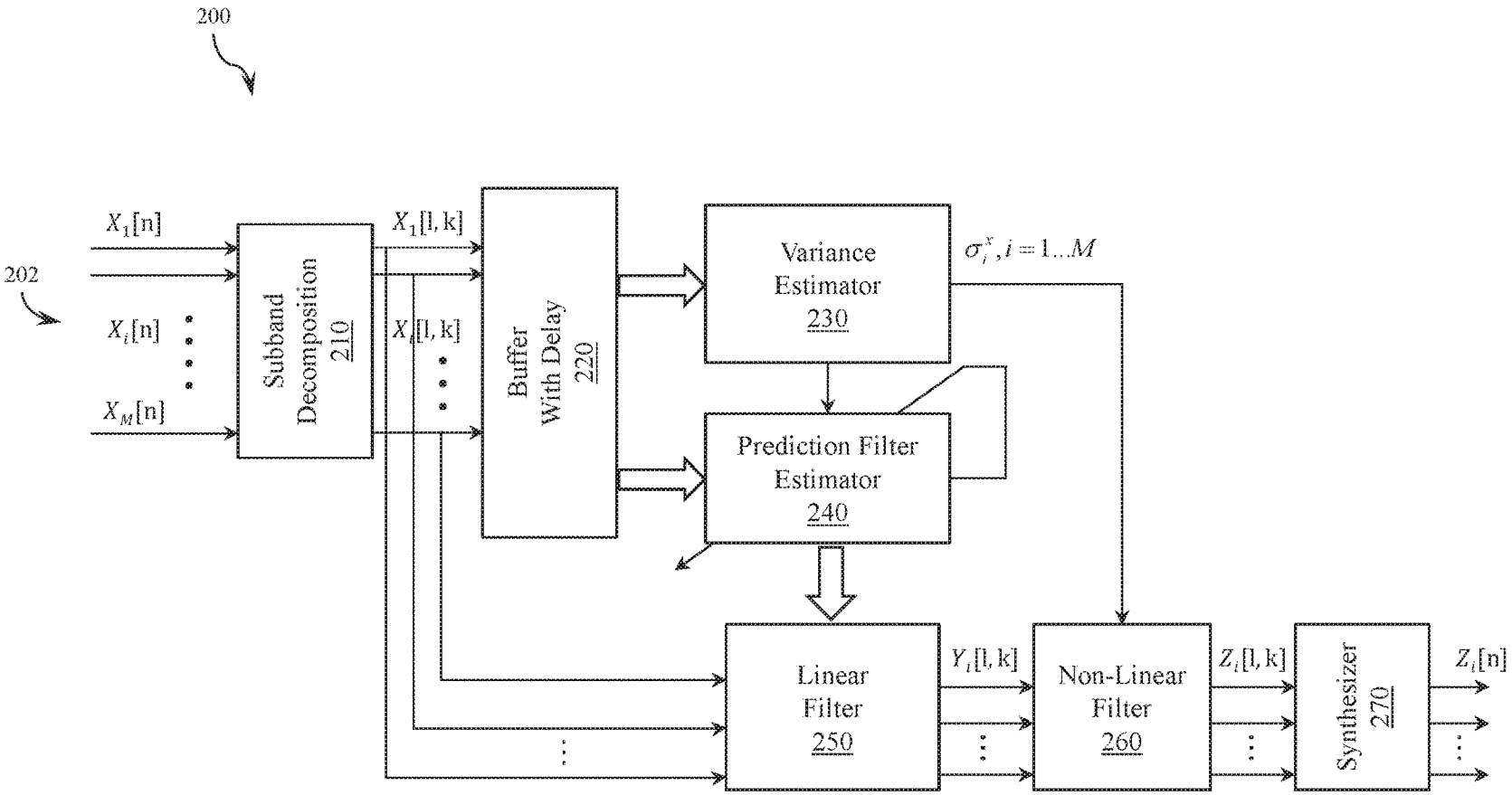
FIG. 2 is a block diagram of an audio processing system including speech dereverberation in accordance with an embodiment of the present disclosure.

Embodiments of the present disclosure will now be described. As illustrated in FIG. 1, a speech dereverberation system 100 may process the signals from the microphone array 120 and produce an output signal, e.g., enhanced speech signals, useful for various purposes as described herein. Referring to FIG. 2, an audio processing system including speech dereverberation in accordance with an embodiment of the present disclosure will be described. A system 200 includes a subband decomposition module 210, a buffer 220, a variance estimation components 230, a prediction filter 240, a linear filter 250, a non-linear filer 260 and a synthesizer 270.

Audio signals 202 received from an array of microphones are provided to subband decomposition module 210, which performs a subband analysis to transform time domain signals in subband frames. The buffer 220 stores the last $L_k$ frames of subband signals for all the channels (the number of past frames is subband dependent). The variance estimation component 230 which estimates the variance of the current frame to be used for prediction filter estimation and nonlinear filtering. The prediction filter estimation component 240 uses an adaptive online approach that is fast to converge. The linear filtering component 250 reduces most of the reverberation. The non-linear filtering component 260 reduces the residual reverberation and noise. The synthesizer 270 transforms the enhanced subband domain signals to time-domain.

In operation, the microphone array 202 receives a plurality of input signals. Assume the input signal for i-th channel is denoted by $x_i[n]$, where i=1 . . . M, with M being the is the number of microphones that sense a number of different audio sources, $N_s$. Then the input signal can be modeled as $$x_i[n] = \sum_{j=0}^{\infty} h_i[j]s[n-j] + v_i[n] \quad i = 1, \ldots, M \tag{1}$$

$s[n] \rightarrow [s_1[n] \ . \ . \ . \ s_{N_s}[n]]^T$ a vector of all sources (clean speech)

$h_i[n] \rightarrow [h_{i1}[n] \ . \ . \ . \ h_{iN_s}[n]]$ Room Impulse Response (RIR) between the i-th microphone and each source $v_i[n] \rightarrow$ Background noise for i-th microphone The received signal in Time Fourier Transformation (STFT) domain can be approximately modeled as $$X_i(l,k) \approx \sum_{l'=0}^{L_i-1} H_i(l',k)S(l-l',k) + v_i(l,k) \quad i = 1, \ldots, M \tag{2}$$

where $L_i$ is the length of the RIR in the STFT domain, l is the frame index, and k is the frequency-bin index. The i-th received input signal can be separated into the early reflection part (desired signal) and the late reverberation part as $$\begin{aligned} X_i(l,k) &\approx \sum_{l'=0}^{D-1} H_i(l',k)S(l-l',k) + \sum_{l'=D}^{L_i-1} H_i(l',k)S(l-l',k) + v_i(l,k) \\ &\approx Y_i(l,k) + R_i(l,k) + v_i(l,k) \\ & i = 1, \ldots, M \end{aligned} \tag{3}$$

where D is the tap-length of the early reflections. The goal is to extract the first term in (3) ($Y_i(l,k)$) by reducing the second late reverberation term ($R_i(l,k)$) and the third term ($V_i(l,k)$) in noisy condition.

In one or more embodiments, to estimate the late reverberation part, the late reflections of the RIR are estimated along with the source signal. In order to make this task easier, the dereverberation is performed by converting (3) into an easier multichannel autoregressive model as given below.

$$\begin{aligned} X_i(l,k) &\approx \sum_{l'=0}^{D-1} H_i(l',k)S(l-l',k) + \\ &\quad \sum_{l'=D}^{L_i-1} W_i(l',k)^H X(l-l',k) + v_i(l,k) \\ &\approx Y_i(l,k) + R_i(l,k) + v_i(l,k) \\ & i = 1, \ldots, M \end{aligned} \tag{4}$$

In (4) the only unknown parameter to be estimated is the prediction filter $(W_i(l',k)=[W_{i1}(l',k), \ldots, W_{iM}(l',k)]^T, M\times 1$ vector and $X(l-l',k)=[X_1(l-l',k), \ldots, X_M(l-l',k)]^T, M\times 1$ vector).

In one or more embodiments, to estimate the prediction filter, the Maximum Likelihood (ML) approach is used. In one embodiment, the prediction filter is based on the following assumptions: (1) the received speech signal has a Gaussian Probability Density Function (pdf) and the clean part of the received speech has zero mean with time-varying variance. Also, noise is assumed to have zero mean; (2) the frames of the input signal are independent random variables; and (3) the RIRs do not change or they change slowly.

Considering the above assumptions, the pdf of the input signal for T frames can be written as follows:

$$\begin{aligned} &\overline{X}_i(k) = \{X_i(l,k) \mid l = 0, 1, \ldots, T-1\} \\ &\overline{X}(k) = [\overline{X}_1(k), \overline{X}_2(k), \ldots, \overline{X}_M(k)]^T \text{ is } M\times 1 \text{ vector.} \end{aligned} \tag{5}$$

-continued $$X(l,k) = [X_1(l,k), X_2(l,k), \ldots, X_M(l,k)]^T \text{ is } M\times 1 \text{ vector.}$$

$$\overline{X}(k) \prod_{l=0}^{T-1} \frac{1}{\sqrt{2\pi|\Sigma(l,k)|}} \exp\left(-\frac{(X(l,k)-\mu(1,k))^H \Sigma(l,k)^{-1}(X(l,k)-\mu(1,k))}{2}\right)$$

Where $\mu(l,k)$ is the mean and $\Sigma(l,k)$ is M×M spatial correlation matrix.

As mentioned above, the ML method is used to estimate the prediction filter and so the ML function using logarithm of the pdf in (5) will be considered as the cost function to be maximized.

$$\begin{aligned} &L(\overline{X}(k) \mid W(l,k)) \text{ is the cost function} \\ &L(\overline{X}(k) \mid W(l,k)) = c - \\ &\quad \sum_{l=0}^{T-1} \{\log|\Sigma(l,k)| + ((X(l,k)-\mu(l,k))^H \Sigma(l,k)^{-1}(X(l,k)-\mu(l,k)))\} \end{aligned} \tag{6}$$

According to the above assumptions, the mean can be approximately obtained as $$\begin{aligned} &\mu_i(l,k) \approx 0 + \sum_{l'=D}^{L_i-1} W_i(l',k)^H X(l-l',k) + 0 \\ &\mu(l,k) = [\mu_1(l,k) \ \ldots \ \mu_M(l,k)]^T \end{aligned} \tag{7}$$

In order to be able to practically estimate the prediction filter in an online-manner, it is further assumed that the correlation filter can be approximated by a scaled identity matrix as follows:

$$\Sigma(l,k) = \sigma(l,k) \begin{bmatrix} 1 & 0 & 0 & \ldots & 0 \\ 0 & 1 & \ldots & \ldots & \ldots \\ 0 & \ldots & \ldots & 0 & 0 \\ \ldots & \ldots & 0 & 1 & 0 \\ 0 & \ldots & 0 & 0 & 1 \end{bmatrix}_{(M\times M)} = \sigma(l,k) I_{M'} \tag{8}$$

Now the variance scale $\sigma(l,k)$ can be obtained as $$\begin{aligned} &\sigma(l,k) = \sigma_c(l,k) + \sigma_{reverb}(l,k) + \sigma_{noise}(l,k) \\ &\sigma_c(l,k) = \sum_{j=1}^{N_s} \sigma_j^s(l,k) \end{aligned} \tag{9}$$

Where $\sigma(l,k)$, $\sigma_{reverb}(l,k)$, and $\sigma_{noise}(l,k)$ are the variance of the j-th source signal, the residual reverberation variance and the noise variance, respectively.

Equation (6) for the case of single-channel can be simplified using (8) as weighted Mean Square Error (MSE) optimization problem:

$$MSE(k) = C(k) = \sum_{l=0}^{T-1} \frac{e^2(l,k)}{\sigma(l,k)}, \tag{10}$$

$$e(l,k) = X_1(l,K) - \sum_{l'=D}^{L_i-1} W_1^*(l',k)X_1(l-l',k)$$

for single-microphone case where e(l,k) is the error signal.

In one or more embodiments, to estimate the prediction filter in an online-manner, the MSE cost function will be minimized by selecting the prediction filter $W_1(l',k)$, updating the filter as new data arrives. In this embodiment, the Recursive Least Squares (RLS) filter is used to estimate the prediction filter. To do so, the cost function is revised using a forgetting factor ($0<\lambda\leq 1$) as $$C(k) = \sum_{l=0}^{T-1} \lambda^{T-l} \frac{e^2(l,k)}{\sigma(l,k)} \tag{11}$$

One goal is to minimize the above cost function in an efficient way and reduce both the noise and the reverberation. Below we will describe a proposed system which is shown in the embodiment of FIG. 2 to achieve this goal.

As shown in FIG. 2, the input signals 202 are first transformed into subband frequency domain as it is given in (4) through the subband decomposition module 210. As the reverberation time is frequency-dependent and the length of the RIRs for different microphones is approximately the same, the number of taps of the prediction filter is assumed to be independent to channel but dependent to the frequency. So $L_i$ is substituted by $L_k$ in (4) as $$\begin{aligned} X_i(l,k) &\approx \sum_{l'=0}^{D-1} H_i(l',k)S(l-l',k) + \qquad i = 1, \ldots, M \\ &\quad \sum_{l'=D}^{L_k-1} W_i(l',k)^H X(l-l',k) + v_i(l,k) \\ &\approx Y_i(l,k) + Z_i(l,k) + v_i(l,k) \qquad i = 1, \ldots, M \end{aligned} \tag{12}$$

In order to reduce the memory consumption and improve the performance of the system, we use shorter length for higher frequency bins and longer length for lower frequency bins.

Figure 3:
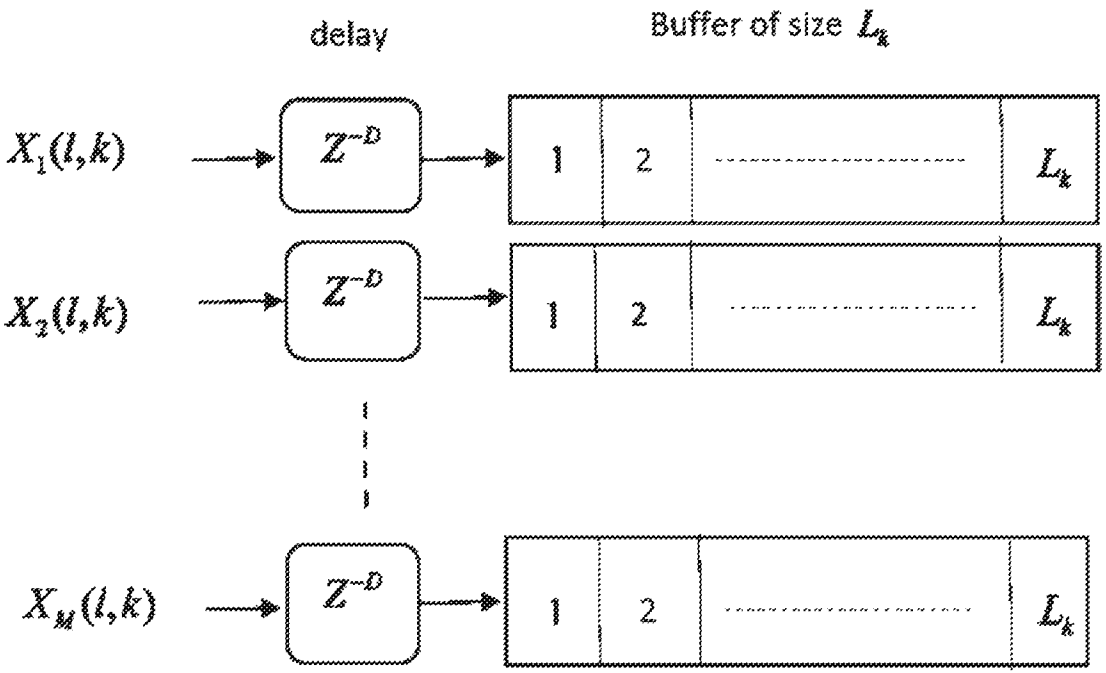
FIG. 3 illustrates a buffer with delay in accordance with an embodiment of the present disclosure.

After the subband decomposition 220, the input signal for each microphone is provided to the buffer with delay 230, and embodiment of which is shown in FIG. 3, for frame l and frequency bin k. The buffer size for the k-th frequency bin is $L_k$. As it is clear from this figure, the recent $L_k$ frames of the signal with a delay of D will be kept in this buffer for each channel.

The final cost function for RLS filter update in (11) has a variance σ(l,k) which is estimated by the variance estimator 230. According to (9), the variance has three components.

Figure 4:
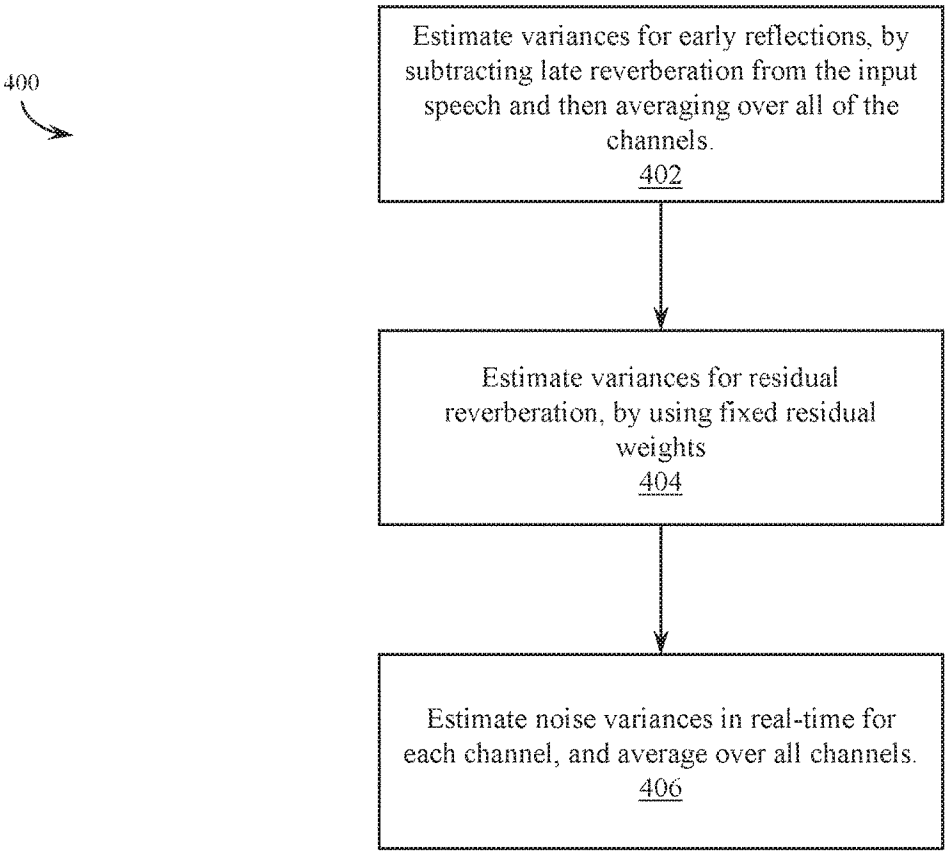
FIG. 4 is a flow diagram for determining variances in accordance with an embodiment of the present disclosure.

Referring to FIG. 4, a method 400 for efficiently estimating each component will be described. In step 402, the variances for early reflections are estimated. In one embodiment, the late reverberation is subtracted from the input speech and then averaged over all of the channels.

$$\sigma^c(l,k) = \frac{1}{M}\sum_{i=1}^{M} \left| X_i(l,k) - \sum_{l'=D}^{L_k-1} W_i(l',k)^H X(l-l',k) \right|^2 \tag{13}$$

where for the late reverberation we use the current prediction filter.

In step 404, the variances for residual reverberation is estimated. From (12), this variance may be estimated using the following equation:

$$\sigma_{reverb}(l,k) = \frac{1}{M}\sum_{l'=0}^{L-1} \tilde{W}_i(l',k) \sum_{m=0}^{M-1} |X_m(l-D-l',k)|^2 \tag{14}$$

Where $\tilde{W}_l(l',k)$ is the residual late reverberation weights for l-th frame which is an unknown parameter. In one embodiment, residual reverberation weights are estimated in an online manner as follows:

$$\begin{aligned} &\text{initialize} \rightarrow \tilde{W}_0(l,k) = \frac{w_0}{ML_k} \\ &Gain_l(l',k) = \frac{\tilde{W}_{l-1}(l',k)}{M\sigma(l,k)} \sum_{m=0}^{M-1} |X_m(l-D-l',k)|^2 \\ &\tilde{W}_l(l',k) = \beta\tilde{W}_{l-1}(l',k) + \frac{Gain_l(l',k)\sum_{m=0}^{M-1} |Y_m(l,k)|^2}{\max\left\{\sum_{m=0}^{M-1} |X_m(l-D-l',k)|^2, \varepsilon\right\}} \end{aligned} \tag{15}$$

Where β and $w_0$ are the forgetting factor (very close to one) and a number for residual weight initialization. ε is a very small number to avoid division by zero. This approach provides good performance in different reverberant environments but it has some drawbacks depending on the implementation. First, it adds additional complexity to the method to estimate the unknown residual reverberation weights for variance estimation. Second, additional memory may be required which is not desirable for many low memory devices (e.g., mobile phones). Third, it is suitable for static environments and the performance may decrease in fast time-varying environments.

To resolve these issues, an alternate approach uses a fixed residual reverberation weight having an exponentially decaying function as given below:

$$\begin{aligned} &R(l') = \frac{l'}{b^2} e^{\left(\frac{-l'^2}{2b^2}\right)} \qquad l' = 0, \ldots, L_k' \\ &R(l') = 0 \qquad l' = L_k'+1, \ldots, L_k \\ &\tilde{W}_l(l',k) = \frac{\eta}{L_k - L_k'} \sum_{j=0}^{L_k-L_k'-1} R(l'-j) \end{aligned} \tag{16}$$

Where b and η are the Rayleigh distribution parameter and a small number in the order of 0.01, respectively. Depending on the number of taps $L_k$, the residual reverberation weights may look like a Gaussian pdf. Experimental results showed this alternate approach is only marginally suboptimal compared, but has lower computational complexity and faster convergence in time-varying environments.

In step 406, the noise variance $\sigma^{\upsilon}(l,k)$ is estimated using an efficient real-time single-channel method and the noise variance estimations are averaged over all the channels to obtain a single value for noise variance $\sigma^{\upsilon}(l,k)$.

Referring back to FIG. 2, the output of the variance estimation component 230 is provided to the prediction filter estimation component 240. The prediction filter estimation component 240 processes the signals based on maximizing the logarithm pdf of the received spectrum, i.e. using maximum likelihood (ML) algorithm, and the pdf is a Gaussian with the mean and variance that are given in (7)-(9).

Rewriting the mean $\mu_i(l,k)$ in (7) in vector form provides:

$$\overline{X}(l,k)=[X_1(l=D,k), \ldots, X_1(l-D-L_k+1,k), \ldots, X_M(l-D,k), \ldots, X_M(l-D-L_k+1,k)]^T$$

$$W_i(k)=[w_1^i(0,k), \ldots, w_1^i(L_k-1,k), \ldots, w_M^i(0,k), w_M^i(L_k-1,k)]^T$$

$$\mu_i(l,k)=\overline{X}(l,k)^T W_i^*(k) \tag{17}$$

Where $w_i^1(k)$ is the prediction filter for frequency band k and i-th channel. Now the error in (11) can be rewritten as:

$$e_i(l,k) = X_i(l,k) - \sum_{m=1}^{M} \sum_{l'=0}^{L_k-1} X_m(l-D-l',k) w_m^{i*}(l',k) \tag{18}$$

In one embodiment, in order to estimate $W_i^1(k)$ in an online manner for l-th frame, the prediction filters, $W_i(k)$, should be initialized by zero values for all the frequency and channels and then gradient of the cost function in (11) which is a vector of $L_k$*M numbers should be computed. The update rule using RLS algorithm can be summarized as follows:

initialize→$w_m(0,k)=0$ and $\Phi(0,k)=\gamma I_M$ $\gamma$ is regularization factor $$RLS_{gain}(k) = \frac{\Phi(l-1,k)\overline{X}(l,k)}{\lambda\sigma(l,k) + \overline{X}^H(l,k)\Phi(l-1,k)\overline{X}(l,k)} \tag{19}$$

$$W_i^{(1)}(k) = W_i^{(l-1)}(k) + RLS_{gain}(k)e_i^*(1,k)$$

$$\Phi(l,k) = \frac{\Phi(l-1,k) - RLS_{gain}(k)\overline{X}^H(l,k)\Phi(l-1,k)}{\lambda}$$

where $\Phi(l,k)$ is a ($L_k M \times L_k M$) correlation matrix.

In this embodiment, the RLS algorithm has fast convergence rate and it generally outperforms other adaptive algorithms, but it has two drawbacks depending on the application. First, the algorithm has both prediction filters and correlation matrix as the unknown parameters. The correlation matrix is a complex matrix and has $K\times(L_k M\times L_k M)$ complex numbers for K frequency bands. This may require a relatively high amount of memory and so the RLS algorithm may not be suitable for certain applications requiring low memory. Also, the computational complexity of this algorithm can be unreasonable for such applications. Second, the RLS algorithm can efficiently convergence towards the exact solution by taking the advantage of the correlation matrix. However, in time varying conditions this might cause of performance issues since the algorithm takes more time to track sudden changes. Below, embodiments providing solutions to both problems are disclosed.

In one embodiment, the complexity of the RLS algorithm is reduced. The correlation matrix given in (19) can be also rewritten as follows:

$$\Phi(l,k) = \left(\frac{\overline{X}(l,k)\overline{X}^H(l,k)}{\sigma(l,k)} + \lambda\Phi(l-1,k)^{-1}\right)^{-1} \tag{20}$$

Computationally, the main part of the update for correlation matrix in (20) is $\overline{X}(l,k)\overline{X}^H(l,k)$. It is noted that the correlation matrix has real values on its main diagonal and has a symmetric matrix form as given below for the two channel case (M=2):

$$\Phi(l,k) = \begin{bmatrix} A_{L_k\times L_k} & C_{L_k\times L_k} \\ C^H_{L_k\times L_k} & B_{L_k\times L_k} \end{bmatrix} \text{ for two channel case } M=2 \tag{21}$$

In (21), it is noted that the most significant components of $\Phi(l,k)$ are the main diagonal of $A_{L_k\times L_k}$, $B_{L_k\times L_k}$ and $C_{L_k\times L_k}$. The other components have amplitude close to zero. By maintaining these diagonals which are real valued for matrices $A_{L_k\times L_k}$, $B_{L_k\times L_k}$ and complex valued for $C_{L_k\times L_k}$, the performance of the RLS algorithm would not significantly affect the results. In one embodiment, the correlation matrix is made sparser by maintaining the values of diagonals as discussed above and zeroing the other components. For example, for the case of two-channels (M=2), this method will decrease the number components of $\Phi(l,k)$ for all the frequencies from $$4\sum_{k=1}^{K} L_k^2 \text{ to } 3\sum_{k=1}^{K} L_k.$$

Most of the components as mentioned above are now real values, which not only decreases the amount of memory usage but also reduces the numerical complexity since the matrix is sparser and the number of multiplications is reduced.

In another embodiment, the performance of the RLS algorithm in time-varying environments is improved. An online adaptive algorithm employing an RLS algorithm to develop the adaptive WPE approach is described in T. Yoshioka, H. Tachibana, T. Nakatani, M. Miyoshi "Adaptive dereverberation of speech signals with speaker-position change detection" Proc. Int. Conf. Acoust., Speech, Signal Process. (2009), pp. 3733-3736, which is incorporated herein by reference. As shown in this paper, the RLS algorithm amplifies the signals after each sudden change. To improve the performance of the detection described in his paper, a binary buffer of length $N_f$ for each channel is used that is initialized by zeros. This buffer will contain a binary decision for the last $N_f$ frames including the current frame. To update this buffer at each frame, the number of frequencies having a negative value for $e_i(l,k)$ in (18) (it is called $F_i$ for each channel i=1, . . . , M) is counted. $F_i$ is compared with a threshold $\tau_1$. If $F_i>\tau_1$, then the buffer is updated with one, otherwise it is set to zero. If the number of ones of this buffer for any channel has exceeded a threshold $\tau_2$, then a sudden change is identified. After the detection occurs, the prediction filter and the correlation matrix of the RLS method will be reset to their initial values as it is discussed before.

After the prediction filter is estimated in 240, the input signal in each channel is filtered by linear filter 250. In one embodiment, the prediction filters are calculated as follows:

$$\tilde{Y}_i(l,k) = X_i(l,k) - \sum_{m=1}^{M} \sum_{l'=0}^{L_k-1} X_m(l-D-l',k) w_m^{j*(l-1)}(l',k) \tag{22}$$

After the linear filtering, nonlinear filtering 260 is performed as $$Z_i(l,k) = \frac{\tilde{Y}_i(l,k)\sigma^c(l,k)}{\sigma(l,k)} \tag{22}$$

If it is desired to compute the enhanced speech signal for $j^{th}$ source $\hat{Y}_i^{(j)}(l,k)$ using the nonlinear filtering, then $\hat{Y}_i^{(j)}(l,k)$ is computed as $$\hat{Y}_i^{(j)}(l,k) = \frac{\hat{Y}_i(l,k)\sigma_j^s(l,k)}{\sigma^c(l,k)} \tag{23}$$

Where $\sigma_j^s(l,k)$ is the corresponding variance for $j^{th}$ source as it is given in (9) and it can be computed using source separation methods as shown in M. Togami, Y. Kawaguchi, R. Takeda, Y. Obuchi, and N. Nukaga, "Optimized speech dereverberation from probabilistic perspective for time varying acoustic transfer function," IEEE Trans. Audio, Speech, Lang. Process., vol. 21, no. 7, pp. 1369-1380, July 2013, which is incorporated herein by reference in its entirety.

After applying the filtering, the enhanced speech spectrum for each band will be transformed from frequency domain to time domain by applying the overlap-add technique followed by an Inverse Short Time Fast Fourier Transform (ISTFT).

The embodiments described herein are configured for operation with the memory and MIPS limitations of a digital signal processor or other smaller platforms for which known computational solutions are typically impracticable. As a result, the present disclosure provides a robust, dereverberation suitable for use in speech control applications for the consumer electronics market and other related applications. For example, speech control of domestic appliances such as smart TVs using speech commands, voice control applications in the automobile industry and other potential applications can be implemented with the systems described herein. Using the embodiments described herein, automated speech recognition may achieve high performance on an inexpensive device that is capable of suppressing non-stationary interfering noises when the target speaker is at far distance from the microphones.

Figure 5:
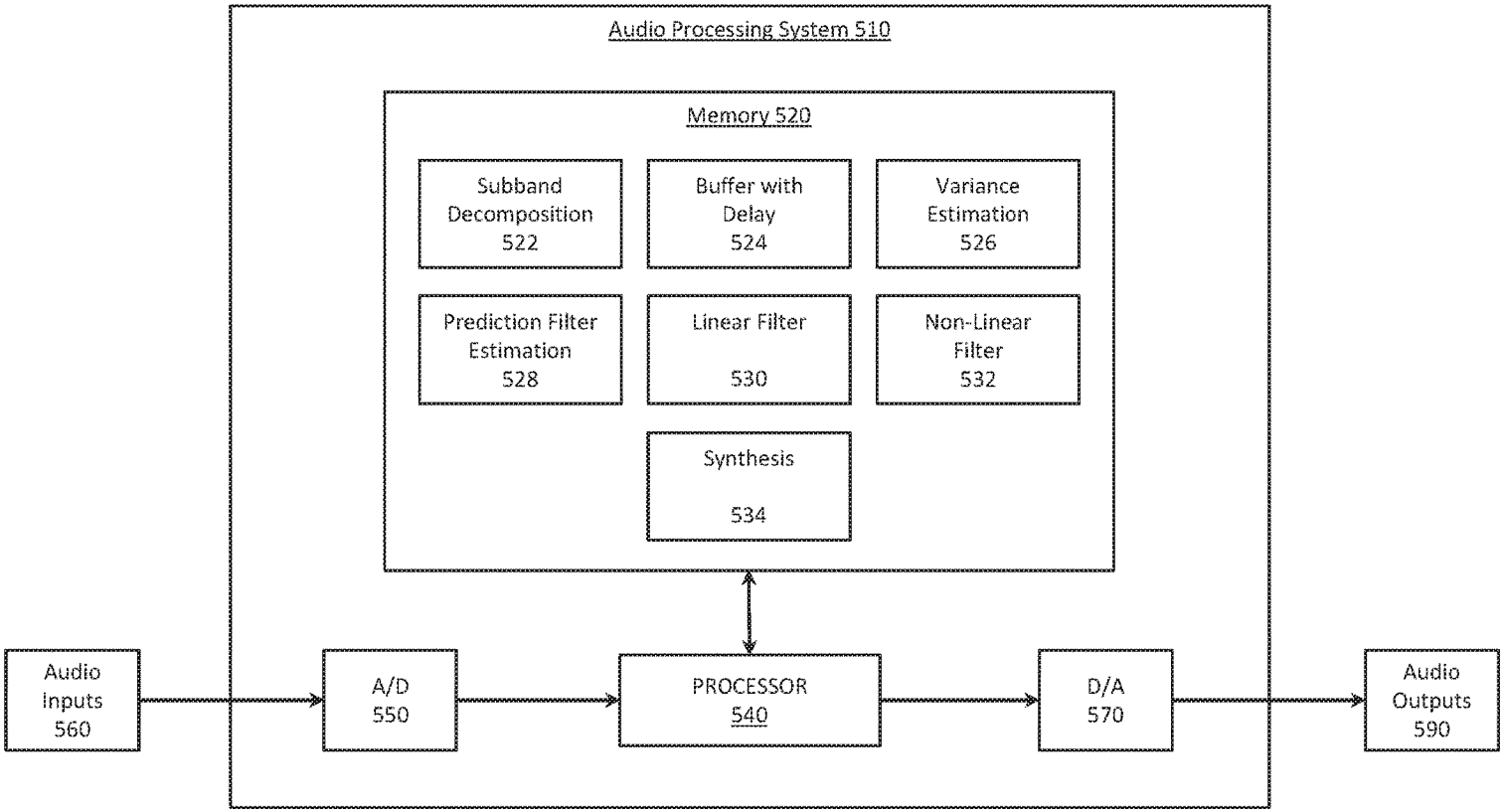
FIG. 5 is a block diagram of an audio processing system in accordance with an embodiment of the present disclosure.

FIG. 5 is a diagram of an audio processing system for processing audio data in accordance with an exemplary implementation of the present disclosure. Audio processing system 510 generally corresponds to the architecture of FIG. 2, and may share any of the functionality previously described herein. Audio processing system 510 can be implemented in hardware or as a combination of hardware and software, and can be configured for operation on a digital signal processor, a general purpose computer, or other suitable platform.

As shown in FIG. 5, audio processing system 510 includes memory 520 and a processor 540. In addition, audio processing system 510 includes subband decomposition module 522, buffer with delay module 524, variance estimation module 526, prediction filter estimation module 528, linear filter module 530, non-linear filter module 532 and synthesis module 534, some or all of which may be stored in the memory 520. Also shown in FIG. 5 are audio inputs 560, such as a microphone array or other audio input, and an analog to digital converter 550. The analog to digital converter 550 is operable to receive the audio inputs and provide the audio signals to the processor 540 for processing as described herein. In various embodiments, the audio processing system 510 may also include a digital to analog converter 570 and audio outputs 590, such as one or more loudspeakers.

In some embodiments, processor 540 may execute machine readable instructions (e.g., software, firmware, or other instructions) stored in memory 520. In this regard, processor 540 may perform any of the various operations, processes, and techniques described herein. In other embodiments, processor 540 may be replaced and/or supplemented with dedicated hardware components to perform any desired combination of the various techniques described herein. Memory 520 may be implemented as a machine readable medium storing various machine readable instructions and data. For example, in some embodiments, memory 520 may store an operating system, and one or more applications as machine readable instructions that may be read and executed by processor 540 to perform the various techniques described herein. In some embodiments, memory 520 may be implemented as non-volatile memory (e.g., flash memory, hard drive, solid state drive, or other non-transitory machine readable mediums), volatile memory, or combinations thereof.

In the illustrated embodiment, the modules 522-534 are controlled by the processor 540. The subband decomposition module 522 is operable to receive a plurality of audio signals including a target audio signal, and transform each of the received signals into the subband frequency domain. The buffer with delay 524 is operable to receive the plurality of subband frequency domain signals and generates a plurality of buffered outputs. The variance estimation module 526 is operable to estimate variance components for the cost function for the RLS filter as described herein. The prediction filter estimation module 528 is operable to use an adaptive online approach that has fast convergence, in accordance with the embodiments described herein. The linear filter module 530 is operable to reduce the party of the reverberation especially the late reverberation that can be reduced by linear filtering. Non-liner filter module 532 is operable to reduce the residual reverberation and noise from the multi-channel audio signal. The synthesis module 534 is operable to transform the enhanced subband domain signal to the time-domain.

There are several advantages to the solution represented by audio processing system 510. First, the solution is a general framework that can be adapted to multiple scenarios and customized to the specific hardware limitations of the computing environment in which it is implemented. The present solution has the ability to run with on-line processing while delivering performance comparable to more complex state-of-the-art off-line solutions. For example, it is possible to separate highly reverberated sources even using only two microphones when the microphone-source distance is large. In some implementations, audio processing system 510 may be configured to selectively recognize a source of the target audio signal that is in motion relative to selective audio processing system 510.

The foregoing disclosure is not intended to limit the present invention to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, persons of ordinary skill in the art will recognize that changes may be made in form and detail without departing from the scope of the present disclosure. Thus, the present disclosure is limited only by the claims.

What is claimed is:

1. A method for processing multichannel audio signals comprising:

receiving an input signal comprising a time-domain, multi-channel audio signal;

transforming the input signal to a frequency domain input signal comprising a plurality of multi-channel frequency domain, k-spaced under-sampled subband signals;

buffering and delaying each channel of the frequency domain input signal;

saving a subset of spectral frames for prediction filter estimation at each of the spectral frames;

estimating a variance of the frequency domain input signal at each of the spectral frames;

adaptively estimating a prediction filter in an online manner by using a recursive least squares (RLS) algorithm and a cost function based at least in part on the estimated variance;

linearly filtering each channel of the frequency domain input signal to reduce reverberation using the estimated prediction filter to produce a linearly filtered output signal;

nonlinearly filtering the linearly filtered output signal to reduce residual reverberation using the estimated variances, producing a nonlinearly filtered output signal; and synthesizing the nonlinearly filtered output signal to reconstruct a dereverberated time-domain, multi-channel audio signal, wherein a number of output channels is equal to a number of input channels.

2. The method of claim 1, wherein estimating the variance of the frequency domain input signal further comprises estimating a clean speech variance.

3. The method of claim 2, wherein estimating the variance of the frequency domain input signal further comprises estimating a noise variance.

4. The method of claim 3, wherein estimating the variance of the frequency domain input signal further comprises estimating a residual speech variance.

5. The method of claim 1, wherein adaptively estimating further comprises using an adaptive RLS algorithm to estimate the prediction filter at each frame independently for each frequency bin of the frequency domain input signal by imposing sparsity to a correlation matrix.

6. The method of claim 5 further comprising detecting changes in speaker movement and resetting the prediction filter and the correlation matrix in response to a sudden change in speaker movement.

7. The method of claim 1, wherein the input signal comprises at least one target signal; and wherein the nonlinear filtering computes an enhanced speech signal for each target signal.

8. The method of claim 7, wherein the nonlinear filtering reduces residual reverberation and background noise.

9. The method of claim 1, wherein estimating the variance of the frequency domain input signal further comprises:

estimating a new clean speech variance based on a previous estimated prediction filter;

estimating a new residual reverberation variance using a fixed exponentially decaying weighting function with a tuning parameter to customize an audio solution; and estimating a noise variance using a single-microphone noise variance estimation method to estimate the noise variance for each channel and then computing an average.

10. The method of claim 1, wherein buffering and delaying each channel of the frequency domain input signal further comprises saving a plurality of spectral frames for each subband of each channel, wherein a number of spectral frames saved differs for at least two subbands.

11. The method of claim 10, wherein at least one subband has a buffer length that is longer than a number of frames saved for a higher frequency subband.

12. An audio processing system comprising:

an audio input operable to receive a time-domain, multi-channel audio signal;

a subband decomposition module operable to transform the input signal to a frequency domain input signal comprising a plurality of multi-channel frequency domain, k-spaced under-sampled subband signals;

a buffer operable to buffer and delay each channel of the frequency domain input signal, saving a subset of spectral frames for prediction filter estimation at each of the spectral frames;

a variance estimator operable to estimate a variance of the frequency domain input signal at each of the spectral frames;

a prediction filter estimator operable to adaptively estimate the prediction filter in an online manner by using a recursive least squares (RLS) algorithm having a cost function based at least in part on the estimated variance;

a linear filter operable to linearly filter each channel of the frequency domain input signal to reduce reverberation using the estimated prediction filter to produce a linearly filtered output signal;

a non-linear filter operable to nonlinearly filter the linearly filtered output signal to reduce residual reverberation using the estimated variances, producing a nonlinearly filtered output signal; and a synthesizer operable to synthesize the nonlinearly filtered output signal to reconstruct a dereverberated time-domain, multi-channel audio signal, wherein a number of output channels is equal to a number of input channels.

13. The audio processing system of claim 12, wherein the variance estimator is further operable to estimate a clean speech variance.

14. The audio processing system of claim 13, wherein the variance estimator is further operable to estimate a noise variance.

15. The audio processing system of claim 14, wherein the variance estimator is further operable to estimate a residual speech variance.

16. The audio processing system of claim 12, wherein the prediction filter estimator is further operable to use an adaptive RLS algorithm to estimate the prediction filter at each frame independently for each frequency bin of the frequency domain input signal by imposing sparsity to a correlation matrix.

17. The audio processing system of claim 16 wherein the variance estimator is further operable to detect changes due to speaker movement and to reset the prediction filter and the correlation matrix.

18. The audio processing system of claim 12, wherein the time-domain, multi-channel audio signal comprises at least one target signal; and wherein the nonlinear filter is further operable to compute an enhanced speech signal for each target signal.

19. The audio processing system of claim 18, wherein the nonlinear filter is operable to reduce residual reverberation and background noise.

20. The audio processing system of claim 12, wherein the variance estimator is further operable to:

estimate a new clean speech variance based on a previous estimated prediction filter;

estimate a new residual reverberation variance using a fixed exponentially decaying weighting function with a tuning parameter to customize an audio solution; and estimate a noise variance using a single-microphone noise variance estimation method to estimate the noise variance for each channel and then computing an average.

* * * * *